US005848922A

United States Patent [19]

Itima et al.

[11] Patent Number: 5,848,922

[45] Date of Patent: Dec. 15, 1998

[54] HYDROFOIL STABILIZER FOR MARINE MOTOR

[76] Inventors: Romeo Itima; Helen Itima, both of 12945 S. Post Oak #290, Houston, Tex. 77045

[21] Appl. No.: 865,731

[22] Filed: May 30, 1997

[51] Int. Cl.[6] ..... B36H 1/18

[52] U.S. Cl. ..... 440/66; 114/274; 440/67

[58] Field of Search ..... 114/274, 145 A, 114/166; 440/66, 67, 71, 72

[56] References Cited

U.S. PATENT DOCUMENTS

| | | | |
|---|---|---|---|
| 2,551,371 | 5/1951 | Grigg | 440/71 |
| 2,963,000 | 12/1960 | Fester | 440/71 |
| 3,149,605 | 9/1964 | Broadwell | 440/67 |
| 5,127,353 | 7/1992 | Wieser | 114/145 A |
| 5,493,990 | 2/1996 | Dyer | 114/145 A |

*Primary Examiner*—Sherman Basinger

[57] ABSTRACT

A hydrofoil stabilizer for a marine motor includes a hydrofoil wing having a generally planar configuration and a shroud member affixed to an underside of the hydrofoil wing. The shroud member has a generally tubular configuration so as to extend around an exterior of the propeller of the marine motor. The hydrofoil wing is affixed to an underside of the anti-cavitation plate of the marine motor. The hydrofoil wing has a first edge with a notch formed therein so as to receive a portion of the marine motor. A forward edge of the hydrofoil wing has inwardly curved forward edges on opposite sides of the notch. The shroud member is affixed to the hydrofoil wing such that a central axis of the shroud member extends at an angle of between 50° and 20° relative to the plane of the hydrofoil wing.

16 Claims, 2 Drawing Sheets

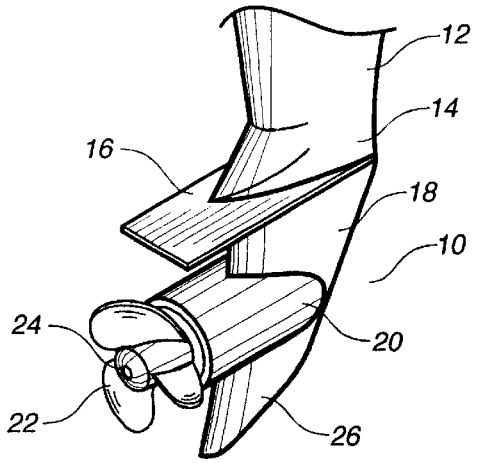
FIG. 1
Prior Art
FIG. 2
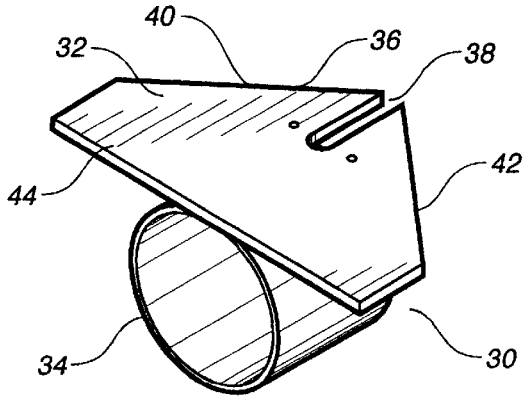
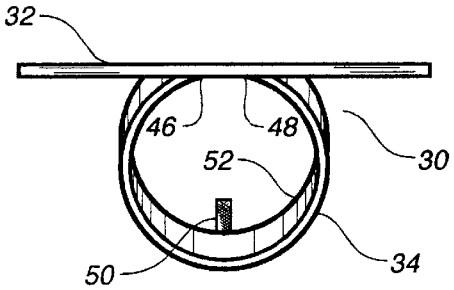
FIG. 3
FIG. 4
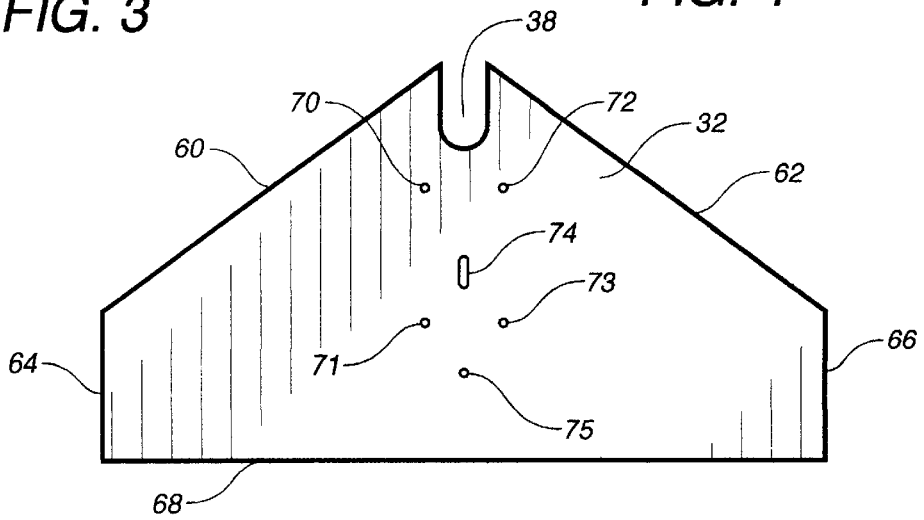

HYDROFOIL STABILIZER FOR MARINE MOTOR

TECHNICAL FIELD

The present invention relates to stabilizers for marine motors. More particularly, the present invention relates to propeller guards for boat propellers. Furthermore, the present invention relates to hydrofoil wings and propeller shrouds for providing additional moment forces acting the force the bow of the boat down during acceleration.

BACKGROUND ART

Outboard and outdrive motors are popular drive mechanisms for pleasure boats and the like. The motors are versatile and provide sufficient power for recreational activities. In fact, boat owners often equip pleasure boats with outboard motors that have excessive horsepower for the size and type of boat. When a boat is so equipped, the bow of the boat can rise dangerously out of the water during rapid acceleration and the boat can porpoise at higher speeds.

In the past, various patents have issued on various devices that surround the propeller of a marine motor. For example, U.S. Pat. No. 5,501,622, issued on Mar. 26, 1996, describes a guard for an outboard motor which has a protective housing having a pair of forward intake ports and a rearward exit port. The protective housing is secured to the lower support unit of the marine motor. The protective housing extends around the gear casing, the propeller hub and the propeller blades below and parallel to the anti-cavitation plate and above the skeg.

U.S. Pat. No. 5,482,482, issued on Jan. 9, 1996, to G. W. Davis describes a cowling that surrounds a propeller and provides an annular blanket of air around the slip stream around the propeller. The cowling includes an inner conical section around the propeller and an outer tubular section around the conical section so as to form an annular space around the conical section.

U.S. Pat. No. 5,389,021, issued on Feb. 14, 1995, to J. A. Padgett describes a motorboat propeller safety shroud which includes a shroud housing which is positioned around the propeller so as to provide a safety barrier for the propeller in its underwater environment. The shroud housing has a converging exit cone containing a horizontal control vein between the sides of the cone.

U.S. Pat. No. 4,637,801, issued on Jan. 20, 1987, to W. C. Schultz describes a propeller duct assembly which enhances the thrust of the propeller. This duct assembly includes a shroud housing that is affixed to the marine motor and extends around the exterior of the propeller.

U.S. Pat. No. 5,307,754, issued on May 3, 1994, to N. Leonardis describes a hydrofoil stabilizer which is shaped to have a central portion adapted to attach to an existing cavitation plate of the motor. The stabilizer has two upwardly sloping portions which approximate the bottom of the marine craft. Two peripheral portions are adapted to improve the stability of the craft by running in relatively less turbulent water away from the immediate vicinity of the propeller.

U.S. Pat. No. 5,138,966, issued on Aug. 18, 1992, to W. M. Whitley II describes a hydrofoil for mounting on the lower portion of a marine motor. Each hydrofoil includes an upwardly angled wing segment and a wingtip fin at the outer end of the wing segment. The hydrofoils are mounted in a pair on the lower portion of the marine motor and form a V-shaped assembly.

U.S. Pat. No. 5,098,321, issued on Mar. 24, 1992, to G. Taylor, Jr. describes a propeller guard having a cylindrically shaped ring which includes a plurality of evenly spaced openings therethrough. The openings are formed so as to allow water to pass therethrough during operation. The ring is formed in a generally tapered rectangular cross-section in order to minimize the drag and vibration characteristics thereof.

U.S. Pat. No. 4,832,634, issued on May 23, 1989, to A. L. Kearns describes a device for improving the efficiency of a boat motor and includes a tubular shroud body portion which includes a pair of half-sections pivotally secured to one another about a first pair of lower, axially aligned edges. Forward and rearward grills are provided to prevent inflow of debris into the shroud. The shroud body portion tapers axially from the forward end to the rearward end to create a venturi effect as the flow exits the shroud.

U.S. Pat. No. 4,304,558, issued on Dec. 8, 1981, to T. J. Holtermann describes an annular shroud that surrounds the propeller blades of a marine motor. The shroud, which can be in the form of a Kort-type nozzle, augments the propeller thrust and has a trailing edge located rearwardly of the travel path of the propeller blade tips. The trailing edge of the shroud includes an annular recess through which either engine exhaust gases or atmospheric air is delivered to ventilate the low pressure area created behind the trailing edge of the shroud during the forward movement of the lower unit through the water.

It is an object of the present invention to provide a hydrofoil stabilizer apparatus that provides a moment force to the stern of the boat.

It is another object of the present invention to provide a hydrofoil stabilizer apparatus that causes the bow of the boat to remain lower in the water during acceleration and during high speed operation.

It is a further object of the present invention to provide a hydrofoil stabilizer that improves visibility and increases safety.

It is a further object of the present invention to provide a hydrofoil stabilizer that reduces the porpoising of the boat.

It is a further object of the present invention to provide a hydrofoil stabilizer that improves the available horsepower of the marine motor.

It is still a further object of the present invention to provide a hydrofoil stabilizer which serves to protect marine mammals and other life in the vicinity of the marine propeller.

It is still another object of the present invention to provide a hydrofoil stabilizer that improves boat speed and also saves gas.

These and other objects and advantages of the present invention will become apparent from a reading of the attached specification and appended claims.

SUMMARY OF THE INVENTION

The present invention is a hydrofoil stabilizer for a propeller of a marine motor that comprises a hydrofoil wing having a generally planar configuration and a shroud member affixed to an underside of the hydrofoil wing. The shroud member has a generally tubular configuration. The shroud member extends around the propeller of the marine motor and has an inner diameter which is greater than the diameter of the propeller.

The hydrofoil wing has a forward edge with a notch formed therein. This notch serves to receive a portion of the marine motor. The forward edge of the hydrofoil wing has inwardly curved forward edges on opposite sides of the notch. The hydrofoil wing has a generally rectangular rear portion. The shroud member extends from an underside of the rear portion. The hydrofoil wing has a generally planar configuration.

The shroud member has a generally tubular configuration. The hydrofoil wing will extend as a chord across the generally circular cross-section of the tubular configuration. The shroud member is affixed to the hydrofoil wing such that a central axis of the shroud member extends at an angle of between 5° and 20° relative to the plane of the hydrofoil wing.

BRIEF DESCRIPTION OF THE DRAWINGS

FIG. 1 is a perspective view of a conventional marine motor.

FIG. 2 is a perspective view of the hydrofoil stabilizer in accordance with the present invention.

FIG. 3 is a rear view showing the hydrofoil stabilizer of the present invention.

FIG. 4 is a plan view of the hydrofoil stabilizer in accordance with the present invention.

DETAILED DESCRIPTION OF THE INVENTION

Figure 5:
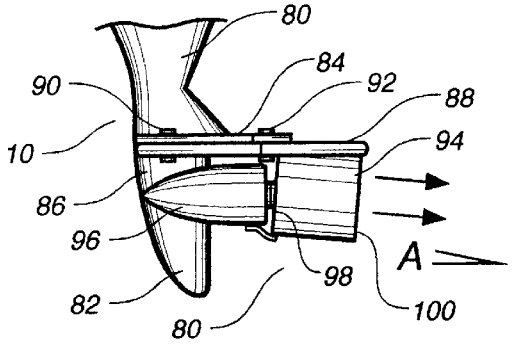
FIG. 5 is a side elevational view showing the hydrofoil stabilizer of the present invention as affixed to the marine motor.

Referring to FIG. 1, there is shown at 10 a marine motor in accordance with conventional prior art practice. Marine motor 10 is suitable for attachment to a boat or other marine vessel. Conventionally, the marine motor 10 will be affixed, in a pivotal fashion, to the rear of a boat so that the marine motor can be pivotted, with respect to the boat, for guiding the boat in the water. The marine motor 10 includes the outboard motor 12 with a drive shaft housing 14. An anti-cavitation plate 16 is affixed to the drive shaft housing so as to extend in a generally horizontal plane with respect to the surface of water in which the motor 10 is located and extends generally transverse to the drive shaft. The anti-cavitation plate 16 is affixed around the lower support unit 18 of the motor 10. A propeller housing 20 is connected to the lower support unit 18 so as to allow the drive shaft 14 from the motor 12 to be connected to the shaft connected to a propeller 22. As can be seen, the propeller 22 extends outwardly of the propeller housing 20. The propeller 20 will rotate about a central axis 24. A skeg 26 extends below the propeller housing 20 and below the lower support unit 18.

Referring to FIG. 2, there is shown at 30 the hydrofoil stabilizer in accordance with the preferred embodiment of the present invention. The hydrofoil stabilizer 30 includes a hydrofoil wing 32 and a shroud member 34 which is affixed to an underside of the hydrofoil wing. As can be seen, the shroud member 34 has a generally tubular configuration. In actual use, the shroud member 34 will have a diameter of which is greater than a diameter of the propeller 22.

The hydrofoil wing 32 has a forward edge 36 with a notch 38 formed centrally therein. The notch 38 is designed so as to receive an exterior portion of the marine motor 10. The forward edge 36 of the hydrofoil wing 32 has a first inwardly curved forward edge 40 and a second inwardly curved forward edge 42. The first edge 40 is located on an opposite side of the notch 38 from the second edge 42. The hydrofoil wing 32 has a generally rectangular rear portion 44. The shroud member 34 extends from an underside of this rear portion 44. It can be seen that the hydrofoil member 32 is a planar member.

The inwardly curved forward edges 40 and 42 of the hydrofoil wing 32 serve to reducer the drag created by the hydrofoil stabilizer 30.

The shroud member 34 has a generally tubular configuration. In the preferred embodiment of the present invention, the hydrofoil wing 32 extends as a chord across the generally circular cross-section of the tubular configuration of the shroud member 34. As will be described hereinafter, the shroud member 34 is affixed to the hydrofoil wing 32 such that a central axis of the shroud member 34 extends at an angle of between 5° and 20° relative to the plane of the hydrofoil wing 32. The angled positioning of the shroud member 34 with respect to the hydrofoil wing 32 provides a moment force to stern of the boat that causes the bow of the boat to remain lower in the water during acceleration and high speed operation. The operation of the boat with a lower bow position increases visibility and safety and reduces the porpoising of the boat when operated at high speeds.

FIG. 3 illustrates the relationship between the hydrofoil wing 32 and the shroud member 34 of the hydrofoil stabilizer 30. As can be seen, the hydrofoil wing 32 is a relatively planar member that extends in a generally horizontal plane relative to the surface of the water. The hydrofoil wing 32 will extend, in normal use, in generally parallel relationship to a longitudinal axis of the shaft 24 of the propeller 22.

The shroud member 34 has a first edge 46 and a second edge 48 which extend in generally parallel relationship along a length of the shroud member 34. First edge 46 is in generally parallel spaced relationship from the second edge 48. As will be described hereinafter, the first edge 46 can be bolted to the hydrofoil wing on one side of the notch 38. The second edge 48 is bolted to the hydrofoil wing 32 on an opposite side of the notch 38. As can be seen in FIG. 3, the uppermost portion of the shroud 34 directly contacts the hydrofoil wing 32. This contact is such that the hydrofoil wing 32 actually forms a "chord" across the generally circular configuration of the shroud member 34. A mounting strap 50 is affixed to a back edge 52 of the shroud 34 so as to allow the shroud member 34 to be secured to a lower portion of the motor 10.

FIG. 4 shows a plan view of the hydrofoil wing 32 in accordance with an alternative embodiment of the present invention. In FIG. 4, it can be seen that the hydrofoil wing 32 has a forward notch 38 which serves to receive the lower support unit 18 of a marine motor 10. Inwardly extending linear forward edges 60 and 62 extend from sides 64 and 66, respectively, of the hydrofoil wing 32. The back edge 68 extends transversely to sides 64 and 66. Importantly, so as to allow the hydrofoil wing to be secured to the anti-cavitation plate 16 of the motor 10, bolt holes 70, 71, 72, and 73 are provided through the thickness of the hydrofoil wing 32 so as to allow the hydrofoil wing 32 to be appropriately secured to the first edge 46 and the second edge 48 of the shroud member 34. A cooling water inlet aperture 74 is also formed through the thickness of the hydrofoil wing 32. An additional bolt hole 75 is provided on the hydrofoil wing 32 so as to allow the hydrofoil wing to be appropriately secured to the anti-cavitation plate of the motor 10. Various other arrangements of holes can be incorporated on the hydrofoil wing so as to allow the wing 32 to be appropriately adapted to the various configurations of motors 10.

FIG. 5 shows how the hydrofoil stabilizer 30 is secured to the motor 10. In FIG. 5, it can be seen that the motor 10 includes a drive shaft housing 80, a skeg 82, an anti-cavitation plate 84, and a lower support unit 86. The hydrofoil wing 88 is bolted directly to an underside of the anti-cavitation plate 84. It can be seen that bolts 90 and 92 serve to secure the hydrofoil wing to the anti-cavitation plate 84. Bolts 90 and 92 will also be located on the opposite sides of the anti-cavitation plate 84. The shroud member 94 is affixed to an underside of the hydrofoil wing 88 so as to extend around the propeller (on the interior of the shroud member 94). It can be seen that the propeller housing 96 will extend upwardly to an end 98 of the shroud member 94. The end 94 of the shroud member 94 is configured so as to allow water to pass therethrough and then outwardly through the opposite end 100 of the shroud member 94.

Importantly, the shroud member 94 is affixed to the hydrofoil wing 88 so as to be oriented at an angle "A" of between 5° and 20° relative to the plane of the hydrofoil wing 88. As a result of this angling of the shroud member 94, the water that is discharged by the propeller on the interior of the shroud member 94 is directed downwardly at an angle when exiting the opening 100. The angled positioning of the shroud member 94 with respect to the hydrofoil wing 88 provides a moment force to the stern of the boat so as to cause the bow of the boat to remain lower in the water during acceleration and high speed operation.

Figure 6:
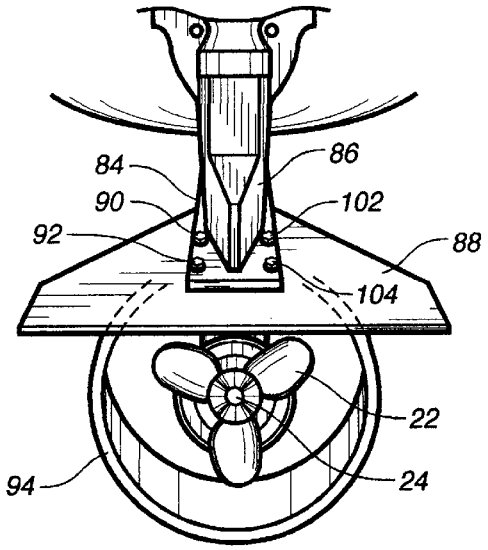
FIG. 6 is an end view showing the hydrofoil stabilizer as affixed to the marine motor.

FIG. 6 shows an end view of the assembly of FIG. 5. As can be seen in this end view, the hydrofoil wing 88 is secured to the anti-cavitation plate 84 on the lower support unit 86 of the marine motor. In particular, it can be seen that the bolts 90 and 92 reside on one side of the notch of the hydrofoil wing 88 while bolts 102 and 104 reside on the opposite side of the notch of the hydrofoil wing 88. Bolts 90, 92, 102 and 104 serve to secure the edges of the shroud member 94 to the underside of the hydrofoil wing 88.

In FIG. 6, it can be seen that the propeller 22 is located centrally within the interior of the shroud member 94. Propeller shaft 24 is central of the shroud member 94 and is in generally parallel relationship to the hydrofoil wing 88.

Figure 7:
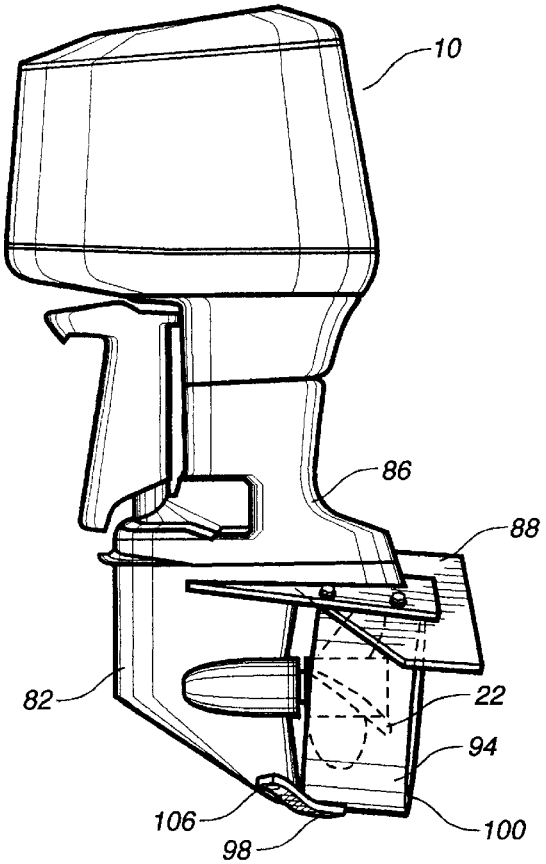
FIG. 7 is a side, partially cross-sectional, view of the hydrofoil stabilizer as attached to the marine motor.

In FIG. 7, the entire outboard motor 10 is illustrated. In FIG. 7, it can be seen that the hydrofoil wing 88 is secured to the lower support unit 86 of the motor 10. The shroud member 94 extends below the hydrofoil wing 88 so as to extend around the propeller 22. It can be seen that the edges of the propeller 22 are contained between the forward edge 100 and the rearward edge 98 of the shroud member 94. A mounting strap 106 is provided so as to secure the lowermost portion of the shroud member 94 to the skeg 82 of the motor 10. The use of the strap 106 serves to prevent the shroud member 94 from bending under rapid accelerations.

In the preferred embodiment of the present invention, the hydrofoil wing and the shroud member are integrally formed together of a plastic material. However, within the scope of the present invention, other construction materials and techniques, such as conventional steel construction, are suitable for practicing the present invention.

In the preferred embodiment of the present invention, the hydrofoil wing will be approximately 24 inches in width and about 14 inches in length. The hydrofoil wing can be made without the bolt holes if the hydrofoil wing and the shroud member are integrally formed together.

The hydrofoil stabilizer of the present invention can easily be mounted to a lower unit of an existing outboard or outdrive marine motor. The hydrofoil stabilizer of the present invention reduces the rise of the bow of the boat during rapid acceleration of the boat. It also reduces the porpoising of the boat when travelling at high speeds. Furthermore, since the shroud member of the present invention extends around the propeller, it creates a "venturi" effect which serves to enhance horsepower, boat speed, and also increases fuel economy. The fact that the shroud member extends around the propeller also protects marine life and other animals from injury from contact with the propeller.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

We claim:

1. An apparatus comprising:

a marine motor having a propeller extending outwardly therefrom;

a hydrofoil wing affixed to said marine motor and extending in a plane parallel to a longitudinal axis of a shaft of said propeller, said marine motor having an anti-cavitation plate affixed thereto, said hydrofoil wing being affixed to an underside of said anti-cavitation plate, said hydrofoil wing having a forward edge with a notch opening thereinto, said notch receiving a portion of said marine motor, said forward edge of said hydrofoil wing having inwardly curved forward edges in a plane of the hydrofoil wing on opposite sides of said notch; and a shroud member affixed to a lower side of said hydrofoil wing and extending around a circumference of said propeller, said propeller positioned interior of said shroud member.

2. The apparatus of claim 1, said hydrofoil wing having a generally rectangular rear portion, said shroud member extending from an underside of said rear portion.

3. The apparatus of claim 1, said hydrofoil wing being a planar member.

4. The apparatus of claim 3, said shroud member having a tubular configuration.

5. The apparatus of claim 4, said hydrofoil wing extending as a chord across a generally circular cross-section of said tubular configuration.

6. The apparatus of claim 1, said shroud member having a first edge and a second edge in generally parallel relationship along a length of said shroud member, said first edge being spaced from said second edge.

7. The apparatus of claim 6, said first edge being bolted to said hydrofoil wing on one side of said marine motor, said second edge being bolted to said hydrofoil wing on an opposite side of said marine motor.

8. An apparatus comprising:

a marine motor having a propeller extending outwardly therefrom, said marine motor having a skew extending downwardly below said propeller;

a hydrofoil wing affixed to said marine motor and extending in a plane parallel to a longitudinal axis of a shaft of said propeller; and a shroud member affixed to a lower side of said hydrofoil wing and extending around a circumference of said propeller above a bottom of said skeg, said propeller positioned interior of said shroud member, said shroud member being affixed to said hydrofoil wing such that a central axis of said shroud member extends at an angle of between 50° and 20° relative to the plane of said hydrofoil wing.

9. A hydrofoil stabilizer for a propeller of a marine motor comprising:

a hydrofoil wing having a generally planar configuration; and a shroud member affixed to an underside of said hydrofoil wing, said shroud member having a generally tubular configuration, said shroud member having a diameter greater than a diameter of the propeller, said shroud member being affixed to said hydrofoil wing such that a central axis of said shroud member extends at an angle of between 5° and 20° relative to the plane of said hydrofoil wing.

10. The stabilizer of claim 9, said hydrofoil wing having a forward edge with a notch formed therein, said notch for receiving a portion of the marine motor.

11. The stabilizer of claim 10, said forward edge of said hydrofoil wing having inwardly curved forward edges on opposite sides of said notch.

12. The stabilizer of claim 11, said hydrofoil wing having a generally rectangular rear portion, said shroud member extending from an underside of said rear portion.

13. The stabilizer of claim 9, said hydrofoil wing extending as a chord across a generally circular cross-section of said tubular configuration.

14. The stabilizer of claim 9, said shroud member having a first edge and a second edge in generally parallel relationship along a length of said shroud member, said first edge being spaced from said second edge.

15. The stabilizer of claim 14, said first edge and said second edge being bolted to an underside of said hydrofoil wing.

16. The stabilizer of claim 9, further comprising:

means for affixing said hydrofoil wing onto a surface of the marine motor such that said shroud member extends directly around the propeller and is above a bottom edge of a skeg of the marine motor.

* * * * *